US005795215A

United States Patent [19]

Guthrie et al.

[11] Patent Number: 5,795,215

[45] Date of Patent: Aug. 18, 1998

[54] METHOD AND APPARATUS FOR USING A RETAINING RING TO CONTROL THE EDGE EFFECT

[75] Inventors: William L. Guthrie; Tsungnan Cheng, both of Saratoga; Sen-Hou Ko, Cupertino; Harry Q. Lee, Mountain View; Michael T. Sherwood, Fremont; Norm Shendon, San Carlos, all of Calif.

[73] Assignee: Applied Materials, Inc., Santa Clara, Calif.

[21] Appl. No.: 667,221

[22] Filed: Jun. 19, 1996

Related U.S. Application Data

[63] Continuation-in-part of Ser. No. 488,921, Jun. 9, 1995, and Ser. No. 549,651, Oct. 27, 1995.

[51] Int. Cl.[6] ..... B24B 5/00

[52] U.S. Cl. ..... 451/286; 451/285; 451/287; 451/288; 451/289; 451/41

[58] Field of Search ..... 451/41, 285–289

[56] References Cited

U.S. PATENT DOCUMENTS 5,584,751 12/1996 Kobayashi et al. ..... 451/287

*Primary Examiner*—James G. Smith
*Assistant Examiner*—George Nguyen
*Attorney, Agent, or Firm*—Fish & Richardson, P.C.

[57] ABSTRACT

A process using a retaining ring assembly of a carrier head to precompress a polishing pad to reduce or minimize the edge effect in a chemical mechanical polishing process.

5 Claims, 9 Drawing Sheets

METHOD AND APPARATUS FOR USING A RETAINING RING TO CONTROL THE EDGE EFFECT

CROSS-REFERENCE TO RELATED APPLICATIONS

The present application is a continuation-in-part of pending U.S. application Ser. No. 08/488,921 filed Jun. 9, 1995, by Norman Shendon et al., entitled FLUID-PRESSURE REGULATED WAFER POLISHING HEAD, and assigned to the assignee of the present application, and is a continuation-in-part of pending U.S. application Ser. No. 08/549,651 filed Oct. 27, 1995, by Michael T. Sherwood et al., entitled CARRIER HEAD DESIGN FOR A CHEMICAL MECHANICAL POLISHING APPARATUS, and assigned to the assignee of the present application, the entire disclosures of which are hereby incorporated by reference.

BACKGROUND OF THE INVENTION

The present invention relates generally to chemical mechanical polishing of substrates, and more particularly to the control of a retaining ring on a carrier head in a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly more non-planar. This occurs because the distance between the outer surface and the underlying substrate is greatest in regions of the substrate where the least etching has occurred, and least in regions where the greatest etching has occurred. With a single patterned layer, this non-planar surface comprises a series of peaks and valleys wherein the distance between the highest peak and lowest valley may be on the order of 7000 to 10,000 Angstroms. With multiple patterned layers, the height differences between the peaks and valleys become even more severe, and can reach several microns.

FIGS. 1A–1E illustrate the process of depositing a layer onto a planar surface of a substrate. As shown in FIG. 1A, a substrate 10 might be processed by coating a circular, flat, silicon wafer 12 with a metal layer 14, such as aluminum. Then, as shown in FIG. 1B, a layer of photoresist 16 may be placed on metal layer 14. Photoresist layer 16 can then be exposed to a light image, as discussed in more detail below, to produce a patterned photoresist layer 16' shown in FIG. 1C. As shown in FIG. 1D, after the patterned photoresist layer is created, the exposed portions of metal layer 14 are etched to create metal islands 14'. Finally, as shown in FIG. 1E, the remaining photoresist is removed.

FIGS. 2A–2B illustrate the deposition of subsequent layers on a substrate. As shown in FIG. 2A, an insulative layer 20, such as silicon dioxide, may be deposited over metal islands 14'. The outer surface 22 of insulative layer 20 replicates the underlying structures of the metal islands, creating a series of peaks and valleys so that outer surface 22 is non-planar. An even more complicated outer surface would be generated by depositing and etching multiple patterned layers.

This non-planar outer surface presents a problem for the integrated circuit manufacturer. If, as shown in FIG. 2B, outer surface 22 of substrate 10 is non-planar, then a photoresist layer 25 placed thereon is also non-planar. A photoresist layer is typically patterned by a photolithographic apparatus that focuses an image onto the photoresist. Such an imaging apparatus typically has a depth of focus of about 0.2 to 0.4 microns for sub-half-micron sized features. If photoresist layer 25 is sufficiently non-planar, i.e., if the maximum height difference h between a peak and a valley of outer surface 22 is greater than the depth of focus of the imaging apparatus, then it will be impossible to properly focus the image onto the entire outer surface 22. Even if the imaging apparatus can accommodate the non-planarity created by a single patterned layer, after the deposition of a sufficient number of patterned layers, the maximum height difference will exceed the depth of focus.

It may be prohibitively expensive to design new photolithographic devices having an improved depth of focus. In addition, as the feature size used in integrated circuits becomes smaller, shorter wavelengths of light must be used, resulting in further reduction of the available depth of focus.

Therefore, there is a need to periodically planarize the substrate surface to provide a planar surface. As shown in FIG. 2C, planarization polishes away a non-planar outer surface, whether a conductive, semiconductive, or insulative layer, to form a relatively flat, smooth outer surface 22. As such, a photolithographic apparatus can be properly focused. Following planarization, additional layers may be deposited on the outer layer to form interconnect lines between features, or the outer layer may be etched to form vias to lower features. Planarization can be performed only when necessary to prevent the peak-to-valley difference from exceeding the depth of focus, or it may be performed each time a new layer is deposited over a patterned layer.

Chemical mechanical polishing (CMP) is one accepted method of planarization. This planarization method typically requires that the substrate be mounted on a carrier or polishing head. The exposed surface of the substrate is then placed against a rotating polishing pad. The carrier head provides a controllable load, i.e., pressure, on the substrate to push it against the polishing pad. In addition, the carrier head may rotate to provide additional motion between the substrate and polishing pad. As the polishing pad rotates, it tends to pull the substrate from beneath the carrier head. To eliminate this problem, the carrier head may be constructed with a downwardly projecting retaining ring. The retaining ring extends circumferentially around the edge of the substrate and forms a recess which retains the substrate beneath the carrier head.

A polishing slurry, including an abrasive and at least one chemically-reactive agent, is spread on the polishing pad to provide an abrasive chemical solution at the interface between the pad and substrate. CMP is a fairly complex process, and differs from simple wet sanding. In a CMP process the reactive agent in the slurry reacts with the outer surface of the substrate to form reactive sites. The interaction of the polishing pad and abrasive particles with the reactive sites results in polishing.

An effective CMP process provides a high polishing rate and generates a substrate surface which is finished (lacks small-scale roughness) and flat (lacks large-scale topography). The polishing rate, finish and flatness are determined by the pad and slurry combination, the relative speed between the substrate and pad, and the force pressing the substrate against the pad. Because inadequate flatness and finish can create defective substrates, the selection of a polishing pad and slurry combination is usually dictated by the required finish and flatness. Given these constraints, the polishing time needed to achieve the required finish and flatness sets the maximum throughput of the CMP apparatus.

A reoccurring problem in chemical mechanical polishing is the so-called "edge effect", i.e., the tendency of the substrate edge to be polished at a different rate than the center of the substrate. The edge effect typically results in over-polishing or under-polishing (the removal of too much or too little material from the substrate) of the perimeter portion, e.g., the outermost five to ten millimeters, of the substrate. The over-polishing or under-polishing of the substrate perimeter reduces the overall flatness of the substrate, makes the edge of the substrate unsuitable for use in integrated circuits, and decreases the yield.

An additional consideration in the production of integrated circuits is process and product stability. To achieve a high yield, i.e., a low defect rate, each successive substrate should be polished under substantially similar conditions. Each substrate should be polished approximately the same amount so that each integrated circuit is substantially identical.

In view of the forgoing, there is a need for a chemical mechanical polishing apparatus which optimizes polishing throughput while providing the desired surface flatness and finish. Specifically, there is a need for a chemical mechanical polishing head which minimizes the edge effect.

SUMMARY OF THE INVENTION

In general, in one aspect, the invention is directed to a method of chemically mechanically polishing a substrate. The substrate is positioned adjacent to a polishing pad by means of a carrier head. The carrier head includes a mounting assembly and a retaining ring. The substrate is moved relative to the polishing pad, and a first load is applied to the mounting assembly to press the substrate against the polishing pad. A second load is selected to be applied by the retaining ring to minimize an edge effect on the substrate, and the second load is independently applied to the retaining ring to press said retaining ring against said polishing pad.

Implementations include the following features. The substrate and/or the polishing pad may rotate to move the substrate relative to the polishing pad. The first load may be greater than or less than the second load.

The advantages of the invention include the following. The carrier head can provide an adjustable load to the retaining ring in order to optimize the retaining ring load and minimize the edge effect. A single carrier head may be used regardless of its rotation rate, the rotation rate of the pad, the load applied to the substrate, the slurry and pad composition, and the gap between the carrier plate and retaining ring.

Additional advantages of the invention will be set forth in the description which follows, and in part will be obvious from the description, or may be learned by practice of the invention. The objects and advantages of the invention may be realized by means of the instrumentalities and combinations particularly pointed out in the claims.

BRIEF DESCRIPTION OF THE DRAWINGS

The accompanying drawings, which are incorporated in and constitute a part of the specification, schematically illustrate embodiments of the invention, and together with the general description given above and the detailed description given below, serve to explain the principles of the invention.

DESCRIPTION OF THE PREFERRED EMBODIMENTS

Figure 3:
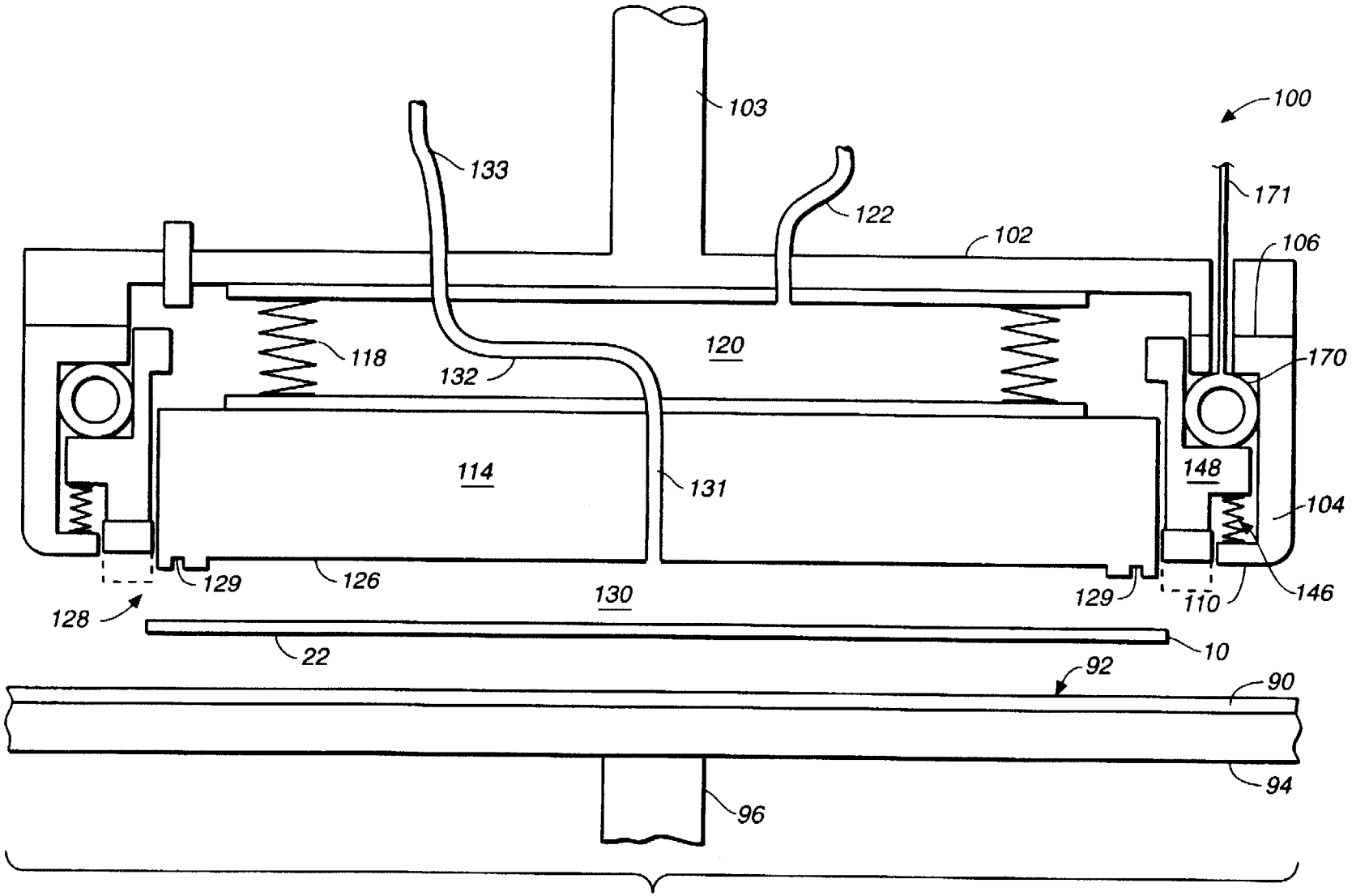
FIG. 3 is schematic sectional view of a carrier head in accordance with the present invention.

As shown in FIG. 3, a CMP apparatus according to the present invention includes a rotating polishing pad 90 having a polishing surface 92. The polishing pad is typically larger than the surface area of a substrate 10 being polished. Polishing pad 92 is affixed to a rotatable platen 94. If substrate 10 is an eight-inch (200 mm) diameter disk, then polishing pad 90 and platen 94 may be twenty or more inches in diameter. Platen 94 is typically an aluminum or stainless steel plate connected by a stainless steel drive shaft 96 to a platen drive motor (not shown). The drive motor rotates the platen, and thus the polishing pad, at thirty to two-hundred revolutions per minute (r.p.m.), although lower or higher rotational speeds may be used.

The CMP apparatus also includes a carrier or carrier head 100 which the substrate is mounted. Generally, carrier head 100 can be considered to comprise several assemblies or mechanisms: a first adjustable loading mechanism which supplies a downward pressure to load the substrate against the polishing surface; a mounting assembly which holds the substrate and transmits the pressure from the first loading mechanism to the substrate; a retaining ring assembly which ensures that the substrate does not slip from beneath the mounting assembly during polishing operations; and a second adjustable loading mechanism which supplies a downward pressure to load the retaining ring against the polishing surface.

The carrier head 100 positions substrate 10 against polishing pad 90 and uniformly loads outer surface 22 of substrate 10 against polishing surface 92. For clarity, the substrate has been shown as detached from the carrier head. The carrier head is supported over the polishing pad and is vertically-fixed relative to the polishing pad by a support member (not shown). This support member provides a fixed bearing location from which the carrier head may extend to provide a desired load on the substrate.

The carrier head 100 includes a housing support plate 102 which is fixedly connected to or is formed integral with a carrier drive shaft 80. The drive shaft 80 connects carrier head 100 to a carrier head drive motor (not shown), which can rotate the carrier head at about thirty to two-hundred r.p.m. Carrier head 100 typically applies a force of approximately four to ten pounds per square inch (psi), although other pressures may be applied, to substrate 10 to press it against polishing surface 92.

The housing support plate 102 may be circular to match the circular configuration of the substrate. A cylindrical descending wall 104 may be secured to the bottom of housing support plate 102 by a top flange 106. The descending wall 104 includes a lower lip 110 which curves inwardly toward substrate 10. The descending wall 104 encloses a retaining ring assembly or mechanism 146, and the retaining ring assembly, discussed in more detail below, encloses a mounting assembly. The mounting assembly may include a disk-shaped substrate backing member 114 and an edge seal feature 128, also discussed in more detail below.

The substrate backing member 114 is attached to housing support plate 102 by a bellows 118 which provides a vertically-expandable sealed chamber 120. Bellows 118 and backing member 114 may be formed of stainless steel. The bellows 118 can expand and contract so that substrate backing member 114 may move relative to housing support plate 102. The bellows chamber 120 is hermetically sealed. It is bound by bellows 118, backing member 114 and housing support plate 102. The bellows chamber 120 can be pressurized or depressurized through a gas lined passage 122 which connects the inside of the bellows to a first pressure or vacuum source (not shown). The expansion or contraction of bellows 118 is controlled by pressurizing or depressurizing bellows chamber 120 via line 122. By pressurizing bellows chamber 120, a force is exerted on backing member 114, and thus on substrate 10, to press the substrate against the polishing surface of the polishing pad. By depressurizing bellows chamber 120, the backing member is lifted away from the polishing surface.

Figure 1A:
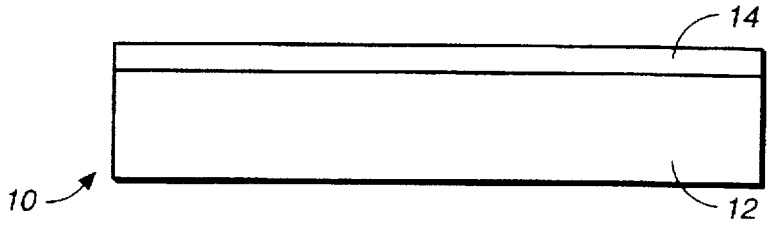
FIGS. 1A–1E are schematic diagrams illustrating the deposition and etching of a layer on a substrate.
Figure 1B:
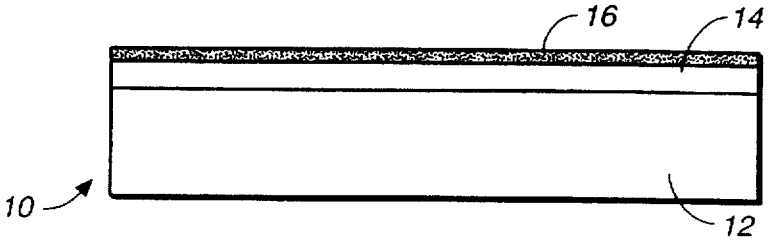
Figure 1C:
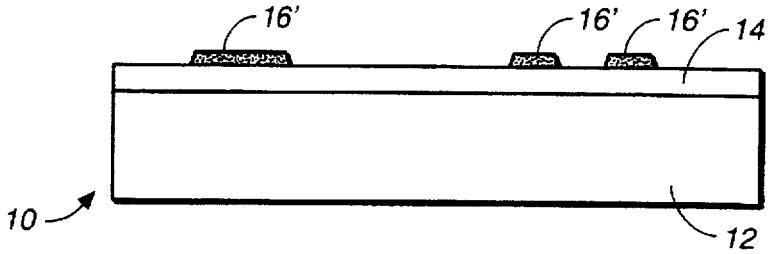
Figure 1D:
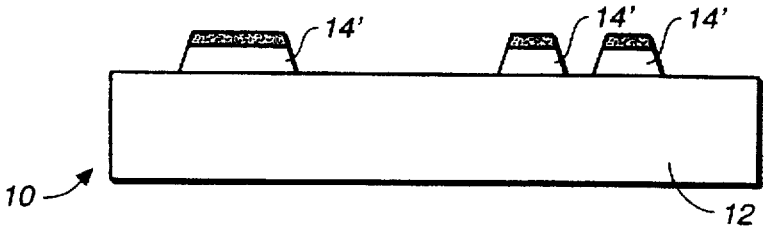
Figure 1E:
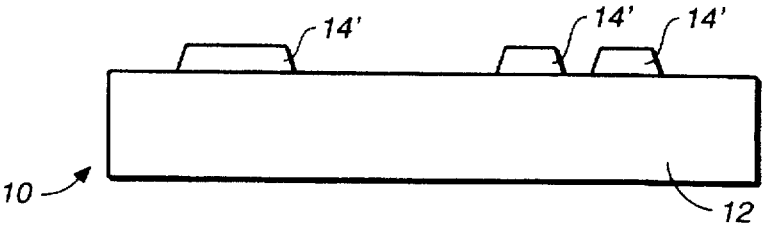
Figure 2A:
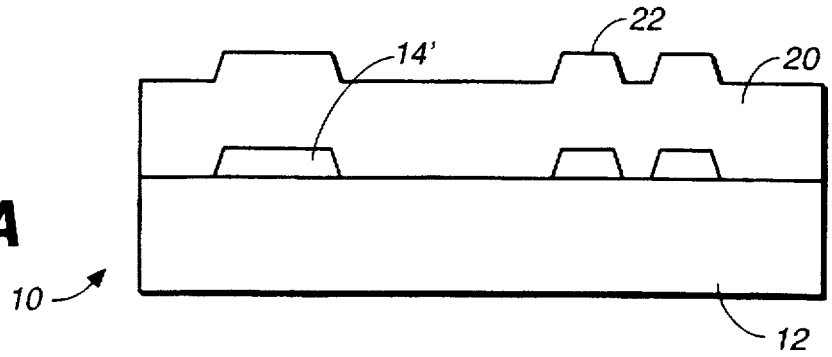
FIGS. 2A–2C are schematic diagrams illustrating the polishing of a non-planar outer surface of a substrate.
Figure 2B:
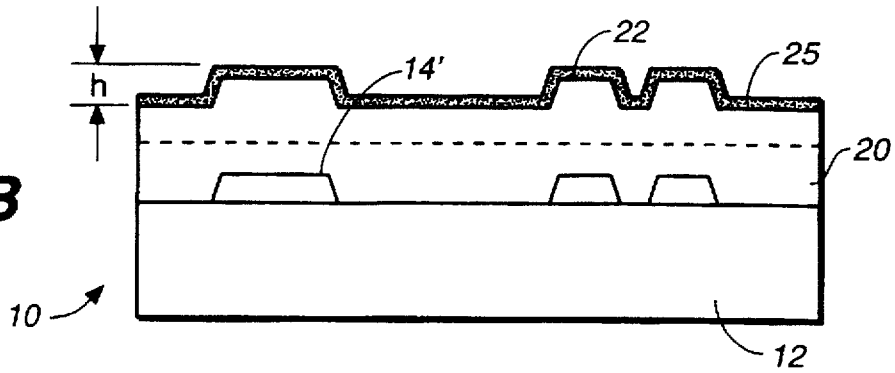
Figure 2C:
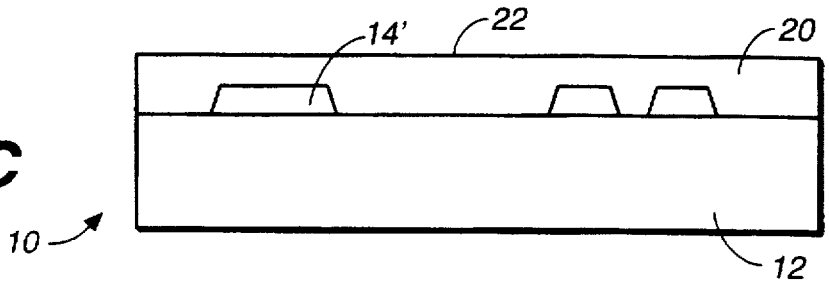

Carrier head 100 includes a circular recess 126 formed in the bottom surface of backing member 114. The outer perimeter of backing member 114 has an edge seal feature 128, e.g., an O-ring (not shown in the empty O-ring groove 129 of FIG. 2, see FIG. 4) or a lip seal (see FIG. 5). The edge seal feature 128 is located and configured to engage the backside of the substrate, thereby forming, in combination with recess 126, a sealable and pressurizable pocket 130 between the substrate and the substrate backing member.

Pocket 130 is connected by a passageway 131 and a hose 132, coiled inside chamber 120, to a gas line or passageway 133. Gas line 133 is, in turn, connected to a second pressure or vacuum source (not shown). A fluid (preferably an inert gas) may be pumped into or evacuated from pocket to pressurize or depressurize pocket 130.

The depressurization of pocket 130 creates a negative differential pressure between substrate backing member 114 and substrate 10 which pulls the center of substrate inwardly. Recess 126 is sufficiently shallow that the stress imposed on the substrate during the maximum possible inward deflection does not exceed the tensile strength of the substrate material.

The pressurization of pocket 130 creates a positive pressure differential between substrate backing member 114 and substrate 10 which pushes the center of the substrate outwardly. The pressure differential may provide a uniform, hydrostatic load across the backside of the substrate. The pressure in bellows chamber 120 loads the substrate against the polishing pad, and pressurized pocket 130 provides a uniform contact pressure between the polishing pad and the substrate. Thus, the first loading mechanism is provided by a combination of bellow chamber 120 and pocket 130. Alternately, the pressure differential may be increased to apply a separating force greater than the sealing force on edge seal feature 128 to detach the substrate from the edge seal feature.

The pressure in pocket 130 may be adjusted as the carrier head moves the substrate to different stations in the CMP apparatus. When the carrier head is moving the substrate to polishing pad 90, for example, the pressure in pocket 130 may be decreased to provide a partial vacuum, e.g., about one-hundred torr less than atmospheric pressure, to hold the substrate to the carrier head. Once the substrate is positioned on polishing pad 90, a gas is pumped into the pocket until a pressure above atmospheric pressure is achieved. Simultaneously, the pressure in bellows chamber 120 is increased, to provide a load to force the substrate against the polishing pad 90. When polishing is complete, the pressure in pocket 130 is decreased so that the carrier head can return the substrate to a transfer station. There, the pressure in the pocket may be increased to provide a super-atmospheric pressure to separate the substrate from the carrier head.

When the carrier head is rotated, edge seal feature 128 provides a frictional force between the substrate and substrate backing member 114 so that the substrate turns with the carrier head. Thus, torque from drive shaft 103 is transferred through the bellows and the substrate backing member to the substrate to rotate the substrate. However, bellows 118 allows substrate backing member 114 to slightly rotate and translate in the x, y, and z directions, relative to housing support plate 102, during rotation of the carrier head and the polishing operation. The flexibility of the bellows accommodates misalignments or changes in the clearance between substrate backing member 114 and the polishing pad.

As the pressure in bellows chamber 120 is increased, 20 it presses edge seal feature 128, whether O-ring seal 134 or lip seal 136 (FIGS. 4 and 5), into contact with the backside of the substrate. The seal deforms under this pressure which enhances its sealing characteristics. Therefore, as the pressure in bellows chamber 120 is increased, the threshold pressure at which gas in pocket 130 will leak past or "blow-by" edge seal feature 128 also increases. If the pressure in the pocket, multiplied by the surface area of the substrate inside edge seal feature 128, exceeds the load force on the seal-substrate interface, the carrier head lifts off the substrate and blow-by occurs. In the carrier head 100, the area of substrate backing member 114 which is circumscribed by bellows 118 is smaller than the area of substrate 10 circumscribed by edge seal feature 128. Therefore, the pressure in the bellows chamber 120 must exceed the pressure in pocket 130 to prevent blow-by.

The pressure in pocket 130 may be approximately seventy-five torr less than the threshold at which blow-by will occur. At these pressures, there will be a uniform pressure on the entire backside of the substrate, except for a small annular area outside the edge seal feature. The uniform pressure on the substrate ensures that the front surface of the substrate is uniformly loaded against polishing pad 90. However, it is specifically contemplated that higher pressures, including a pressure at or above blow-by, may be used. If such higher pressures are used, the seal-substrate interface will serve as a relief valve, and blow-by will occur periodically to maintain a desired pressure within the pocket.

Figure 4:
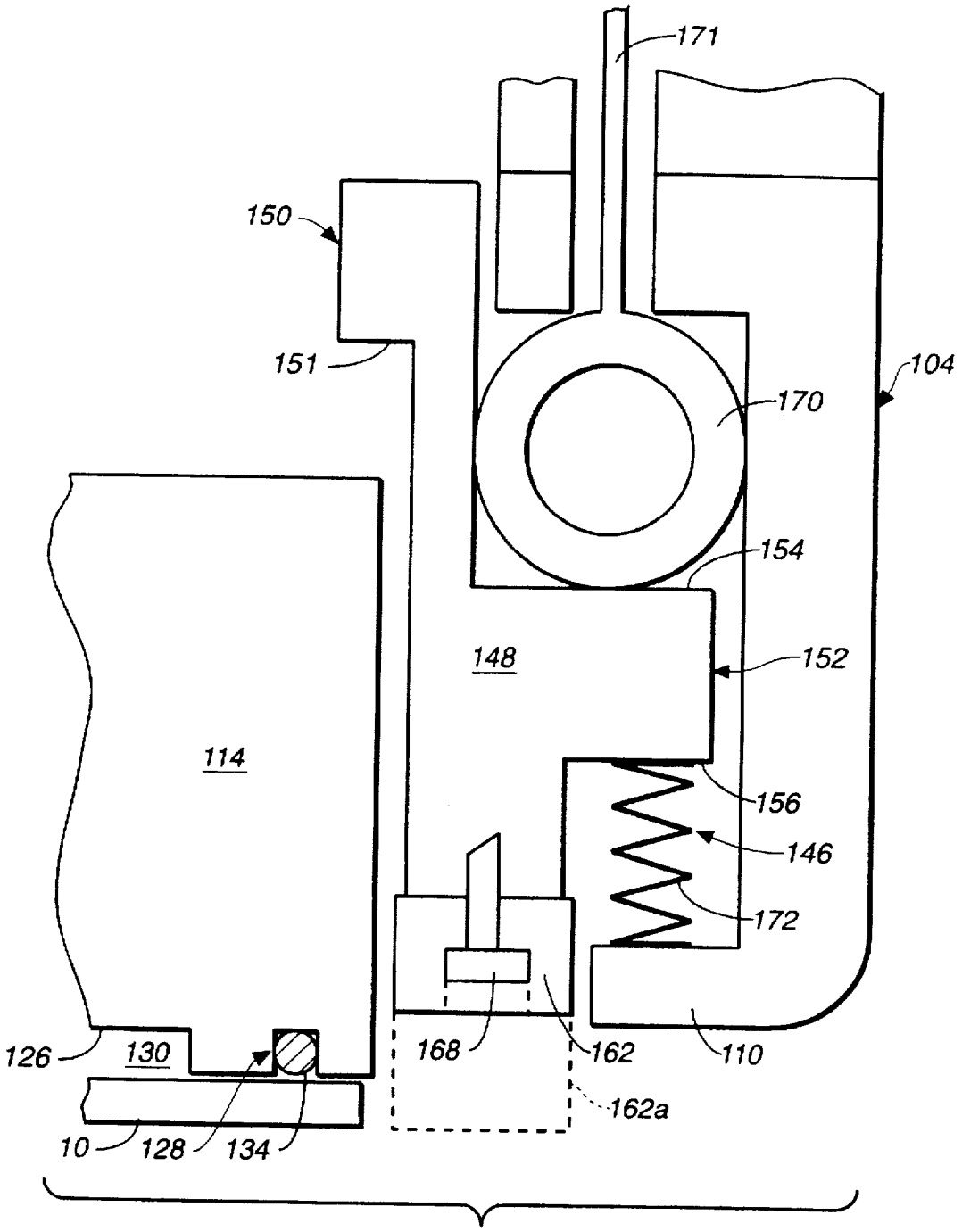
FIG. 4 is an enlarged view of part of the carrier head of FIG. 3, illustrating an O-ring seal.

In the configuration shown in FIG. 4, edge seal feature 128 is a circular O-ring 134 positioned in O-ring groove 129 near the perimeter of substrate backing member 114 and surrounding recess 126. O-ring 134 may be formed of 20 a flexible elastic material such as rubber. A portion of O-ring 134 extends beyond the underside (i.e., substrate engaging side) of backing member 114 to contact the backside of substrate 10 immediately inside its perimeter. The O-ring 134 provides sufficient contact with the substrate to create a frictional rotational force so that the substrate turns with the carrier head. The space between substrate 10 and backing member 114 which is sealed by edge O-ring 124 forms pocket 130.

Figure 5:
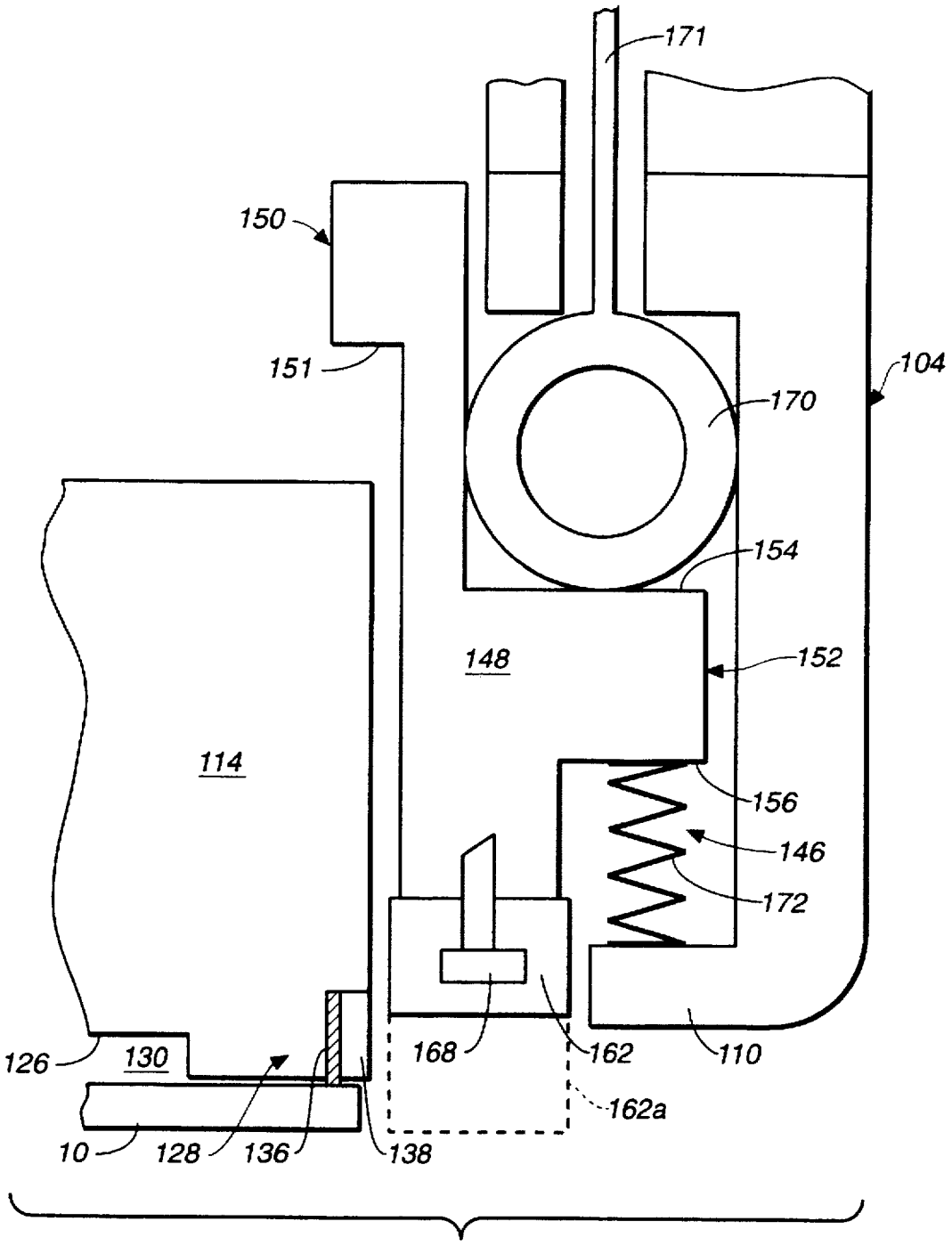
FIG. 5 is an enlarged view of part of the carrier head of FIG. 3 in which a lip seal is used in place of the O-ring seal.

A second configuration of the polishing head of the present invention is shown in FIG. 5. Here, the edge seal feature is a downwardly-extending circular lip seal 136 located around the perimeter of backing member 114. The lip seal 136 is secured to the backing member by a ring 138 extending about the outer circumference of the lip seal. The lip seal 136 may be a thin elastic member having a rectangular cross-section. It may be made of rubber. A portion of lip seal 136 extends beyond the underside of the backing member to contact the backside of substrate 10. The lip seal 136 provides sufficient contact with the substrate to create a frictional rotational force so that the substrate turns with the carrier head. The space between substrate 10 and backing member 114 which is sealed by lip seal 136 forms pocket 130.

As noted, carrier head 100 includes retaining ring assembly 146 which ensures that substrate 10 does not slip out from beneath the carrier head during polishing operations. As shown in FIGS. 4 and 5, the retaining ring assembly 146 includes an annular retaining ring 162 which is attached to an annular backing ring 148. The retaining ring 162 has through-holes and counterbores spaced evenly about the circumference of the retaining ring. Screws 168 extend through the through-holes and are threaded into corresponding threaded holes in backing ring 148 to hold the retaining ring to the backing ring. The retaining ring 162 may be made of a plastic material, and backing ring 148 may be made of aluminum. The backing ring 148 has an inside flange 150 having a lower face 151 which extends inwardly over substrate backing member 114. When substrate backing member 114 is raised, its top surface contacts lower face 151 to raise the retaining ring assembly 146. The backing ring 148 also includes an outside flange 152 having a top face 154 facing an annular expandable bladder 170 and a bottom face 156 in contact with six to twelve compression springs 172.

The backing ring 148 is urged upwardly away from lip 110 of descending wall 104 by compression springs 172. Bladder 170 may be pressurized by a pressure source (not shown) which is connected to the bladder by pressure line 171. When bladder 170 is pressurized, retaining ring assembly 146 is forced downwardly to its operating position (shown by the dashed lines 162*a*). The bladder 170 provides a downward force that opposes the force of compression springs 172, and urges the retaining ring against the polishing pad. In the operating position, the retaining ring surrounds the edge of substrate 10. This prevents the substrate from sliding out from under backing member 114 during polishing. A continuously pressurized bladder could replace the compression springs to provide a uniformly distributed retracting forces.

The lower face 151 of the inside flange 150 is configured so that as the plastic material of retaining ring 162 wears away, the travel of the retaining ring is limited when lower face 151 contacts inside flange 150 and the top of substrate backing member 114. This prevents the heads of screws 168 from coming in contact with the polishing pad and introducing undesirable contaminants or damaging the pad.

Figure 6:
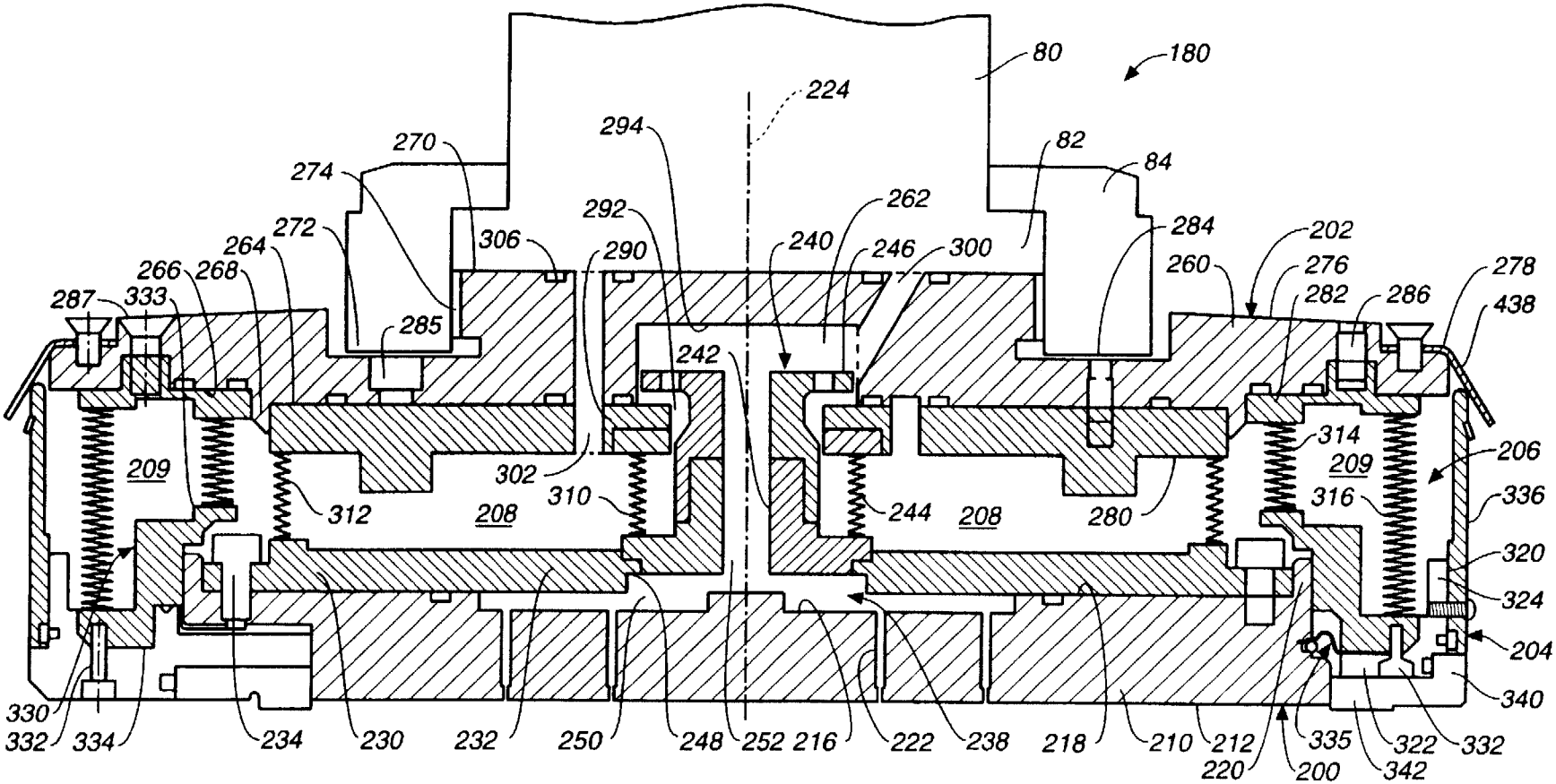
FIG. 6 is an illustrative schematic cross-sectional view of another carrier head in accordance with the present invention in which the right half of the carrier head is configured for an eight-inch diameter substrate and the left half of the carrier head is configured for a six-inch diameter substrate.

In another embodiment, shown in FIG. 6, a carrier head 180 comprises three major assemblies: a mounting or base assembly 200, a housing assembly 202 and a retaining ring assembly 204. A bellows system 206 is positioned between the housing assembly, and the base and retaining ring assemblies. Bellows system 206 provides two adjustable loading mechanisms to create a first load on the base assembly and a second load on the retaining ring assembly. Each of these assemblies is explained in detail below. The right half of FIG. 6 shows a carrier head configured for an eight-inch diameter substrate, whereas the left half of FIG. 6 shows a carrier head configured for a six-inch diameter substrate. The two configurations are substantially similar, but differ in the shape of components of retaining ring assembly 204. A more complete description of carrier head 180 may be found in above noted U.S. application Ser. No. 08/549,651.

Base assembly 200 applies a load to substrate 10; that is, it pushes substrate 10 against a polishing pad. Base assembly 200 can move vertically with respect to housing assembly 202 to carry the substrate to and from the polishing pad. Bellows system 206 connects housing assembly 202 to base assembly 200 to create a primary pressure chamber 208 therebetween. Fluid, preferably air, is pumped into and out of primary pressure chamber 208 to control the load on substrate 10. When air is pumped into primary pressure chamber 208, the pressure in the chamber increases and base assembly 200 is pushed downwardly.

Bellows system 206 also connects housing assembly 202 to retaining ring assembly 204 to create a secondary pressure chamber 209. Fluid, preferably air, is pumped into and out of secondary pressure chamber 209 to control the load on the retaining ring.

As explained below, housing assembly 202 is connected to and rotated by drive shaft 80. When housing assembly 202 rotates, bellows system 206 transfers torque from housing assembly 202 to base assembly 200 and retaining ring assembly 204, and causes them to rotate. However, because the bellows are flexible, the base assembly and retaining ring assembly can independently pivot with respect to the housing assembly in order to remain substantially parallel with the surface of the polishing pad.

Base assembly 200 includes a disk-shaped carrier base 210 having a nearly flat mounting or bottom surface 212 which may contact substrate 10. The top surface of carrier base 210 may include an asterisk-shaped depression 216 having six spokes. Depression 216 is surrounded by an annular area 218. Annular area 218 is itself surrounded by a rim 220. Several conduits 222, evenly spaced about a central axis 224 of carrier head 180, extend through carrier base 210 from bottom surface 212 to depression 216. Preferably, two conduits descend vertically from each spoke of the depression to the bottom surface.

A generally flat annular plate 230 rests primarily on annular area 218, with the outer edge of the annular plate abutting rim 220 of carrier base 210. An inner portion 232 of the annular plate projects over depression 216. Annular plate 230 may be attached to carrier base 210 by screws 234 which extend through passages in the annular plate and engage threaded recesses in the carrier base.

A stop cylinder 240 is mounted in a central opening 238 in annular plate 230. Stop cylinder 240 includes a tubular body 242, a radially-projecting lower flange 244, and a radially projecting upper flange 246. Lower flange 244 is welded to a lip 248 at the inner edge of annular plate 230 to support stop cylinder 240 above the annular plate. The gap between depression 216 in carrier base 210 and lower flange 244 of stop cylinder 240 and inner portion 232 of annular plate 230 creates a cavity 250 in base assembly 200. A central channel 252 extends through tubular body 242 from lower flange 244 to upper flange 246 to provide a fluid pathway to cavity 250 and conduits 222. Stop cylinder 240 may be formed of a top portion which is screwed onto a bottom portion. Spacers may be inserted into a gap between the top and bottom portions to control the length of the stop cylinder.

Housing assembly 202 includes a disk-shaped carrier housing 260. The bottom surface of carrier housing 260 has a cylindrical cavity 262. The carrier bottom surface also includes an inner annular surface 264 and an outer annular surface 266 separated by a ridge 268. The top surface of carrier housing 260 includes a cylindrical hub 270 with a threaded neck 274 which projects above an annular area 272. A gently-sloped section 276 surrounds annular area 272, and a ledge 278 surrounds sloped section 276.

Housing assembly 202 further includes an annular inner plate 280 and an annular outer plate 282. Inner plate 280 is connected to inner annular surface 264 on the bottom of carrier housing 260 by pins 284 and counterbore screws 285, and outer plate 282 is similarly mounted to outer annular surface 266 by pins 286 and counterbore screws 287. Preferably, five pins and five screws connect each plate to the carrier housing. The outer edge of inner plate 280 abuts ridge 268. The inner edge of inner plate 280 projects horizontally under cylindrical cavity 262 to form an inwardly pointing lip 290 surrounding an opening 292. The top of cylindrical cavity 262 is closed by a ceiling 294. Stop cylinder 240 of base assembly 200 extends through opening 292 into cylindrical cavity 262, and upper flange 246 projects horizontally over lip 290.

There are several conduits in housing assembly 202 to provide for fluid flow into and out of the carrier head. A first conduit 300 extends from cylindrical cavity 262 through carrier housing 260 to hub 270. A second conduit 302 extends from the bottom surface of inner plate 280, through carrier housing 260, to hub 270. A third conduit (not shown) extends from the bottom surface of outer plate 282 through carrier housing 260 to hub 270. An O-ring 306 inset into the top surface of hub 270 surrounds each conduit.

Carrier head 180 may be attached to drive shaft 80 by placing two dowel pins (not shown) into dowel pin holes (not shown) and lifting the carrier head so that the dowel pins fit into paired dowel pin holes (not shown) in a drive shaft flange 82. This aligns passages in the drive shaft to the conduits in the carrier head. In operation, the dowel pins transfer torque from the drive shaft to the housing assembly so that the housing assembly rotates with the drive shaft. Then threaded perimeter nut 84 can be screwed onto threaded neck 274 to attach carrier head 180 firmly to drive shaft 80.

Bellows system 206 includes several cylindrical metal bellows disposed concentrically in the space between base assembly 200 and housing assembly 202. Each bellows can expand and contract vertically. An inner bellows 310 connects the inner edge of inner plate 280 and to lower flange 244 of stop cylinder 240 to seal cavity 262 and central channel 252 from primary pressure chamber 208. A pump (not shown) can pump air into or out of conduits 222 through a first conduit 300, cavity 262, central channel 252, and cavity 250. If air is pumped out of the conduits, the substrate will be vacuum-chucked to the bottom surface of the carrier head. If air is pumped into the conduits, the substrate will be pressure-ejected from the bottom surface of the carrier head.

Outer bellows 312 connects the outer edge of inner plate 280 to annular plate 230. The ring-shaped space between concentric inner bellows 310 and outer bellows 312 forms primary pressure chamber 208. A pump (not shown) can pump a fluid, preferably air, into or out of primary pressure chamber 208 through second conduit 302. If fluid is pumped into primary pressure chamber 208, the volume of the chamber will expand until substrate 10 beneath base assembly 200 contacts the surface of the polishing pad. Forcing additional fluid into the primary chamber will increase the pressure and thus increase the downward pressure on substrate 10. The pump may adjust the pressure in the primary pressure chamber and thus the load on the substrate.

When primary pressure chamber 208 expands and base assembly 200 moves downwardly with respect to housing assembly 202, metal bellows 310 and 312 stretch to accommodate the increased distance between annular plate 230 and inner plate 280. However, flange 246 of stop cylinder 240 will catch against lip 290 of housing assembly 202 to stop the downward motion of the base assembly and prevent the bellows from over-extending and becoming damaged.

Retaining ring assembly 204 includes an L-shaped ring support 320 with a inwardly-directed horizontal arm 322 and an upwardly-directed vertical arm 324. A backing ring 330 is attached to the top of horizontal arm 322 by screws 332. An outer portion 333 of backing ring abuts vertical arm 324, and an inner portion 334 of backing ring 330 may project horizontally over rim 220 of carrier base 210. A flexible seal 335 connects retaining ring assembly 204 to carrier base 210 to protect the carrier head from slurry. The outer edge of seal 335 is pinched between horizontal arm 322 and backing ring 330. The inner edge of seal 335 is an O-ring having a smaller radius than the carrier base. The O-ring fits elastically into a notch in carrier base 210 to hold the inner edge of seal 335 in place. A flange 336 is attached to the outside of vertical arm 324 and forms the outer wall of carrier head 180. Flange 336 extends upwardly to almost touch carrier housing 260. A seal 338 rests on ledge 278 and extends over flange 336 to protect carrier head 180 from contamination by slurry. A retaining ring 340 is mounted to the bottom surface of horizontal arm 322 a O-ring which fits partially into a notch in ring support 320. Retaining ring 340 includes a protruding portion 342 which will contact polishing pad 90 and block substrate 10 from slipping out from under base assembly 200.

A third bellows 314 connects the inner edge of outer plate 282 of housing assembly 202 to the inner portion 333 of backing ring 330. A fourth bellows 316 connects the outer edge of outer plate 282 to the outer portion 333 of backing ring 330. The ring-shaped space between concentric third and fourth bellows 314 and 316 forms secondary pressure chamber 209. A pump (not shown) can pump fluid, preferably air, into or out of secondary pressure chamber 209 through the third conduit (not shown). If fluid is pumped into secondary pressure chamber 209, the volume of the chamber will expand until retaining ring 340 contacts the surface of the polishing pad. Forcing additional fluid into the secondary pressure chamber will increase the pressure in the secondary pressure chamber and thus increase the downward pressure on retaining ring 340. Because the primary and secondary chambers are pressurized independently, the base assembly and retaining ring can be independently actuated.

Carrier head 180 may use two preassembled bellows assemblies. Inner bellows 310 and outer bellows 312 are welded to inner plate 280 and annular plate 230 to form the first bellows assembly, and third bellows 314 and fourth bellows 316 are welded to outer plate 282 and backing ring 330 to form the second bellows assembly. The two bellows assemblies are dropped onto housing 260 and attached by screws and pins as discussed above. Then carrier base 210 and ring support 322 may be attached.

As discussed above, a common problem in the chemical-mechanical polishing of substrates is the edge effect, i.e., the over-polishing or under-polishing of the outermost five to ten millimeters of the substrate.

Figure 7A:
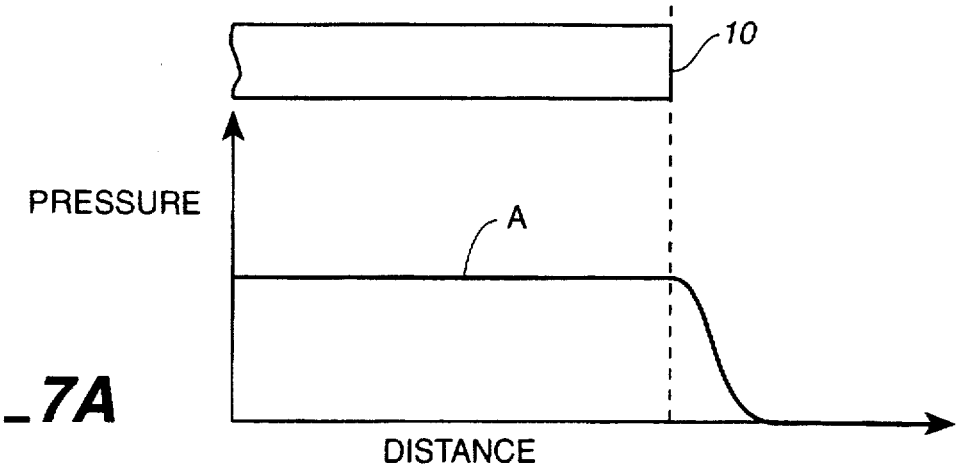
FIG. 7A is a graph showing the pressure on a polishing pad as a function of the distance from the center of a motionless substrate.
Figure 7B:
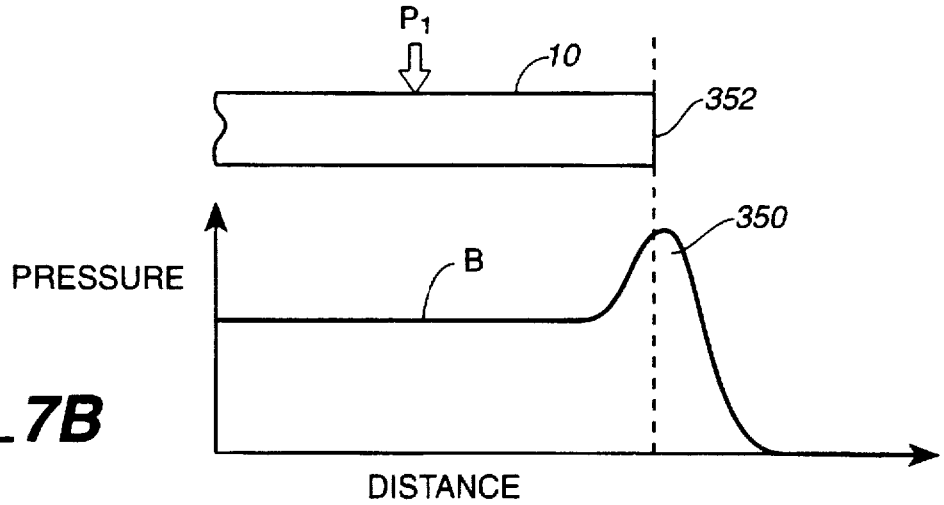
FIG. 7B is a graph showing the pressure on a polishing pad as function of the distance from the center of a moving substrate.
Figure 7C:
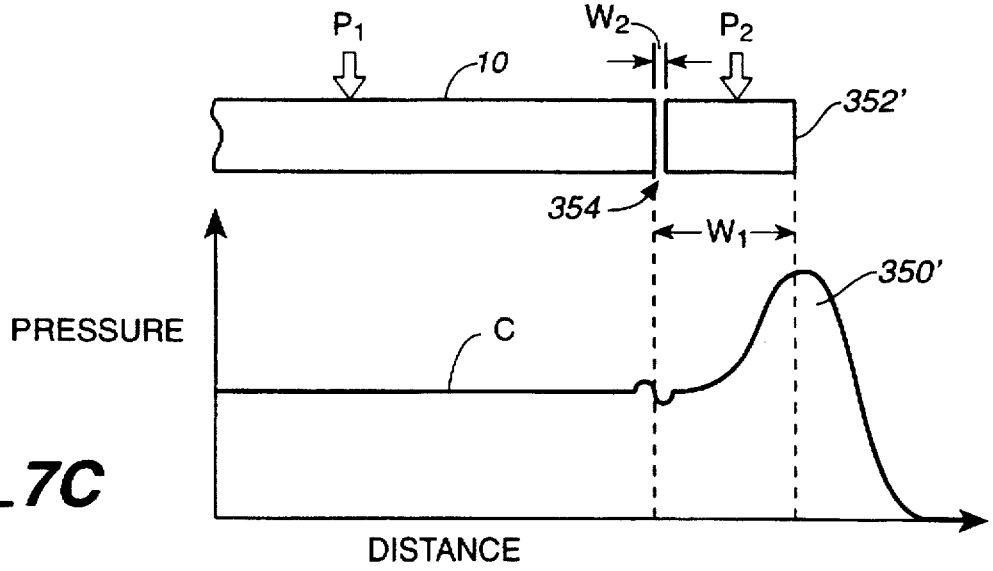
FIG. 7C is a graph showing the pressure on a polishing pad as a function of the distance from the center of a moving substrate surrounded by a retaining ring.

One possible cause of the edge effect is a "standing wave" of high compression in the polishing pad which is generated by the motion of the substrate over the polishing pad. FIGS. 7A–7C illustrate the pressure on polishing pad 90 (on the y-axis) as a function of the distance from the center of the substrate (on the x-axis). Each graph is aligned with, a pictorial representation of the element or elements contacting the polishing pad, i.e., substrate 10 or the substrate and the retaining ring 162 or 340.

Referring to FIG. 7A, the pressure on a polishing pad which is compressed by a motionless substrate 10 (which is not surrounded by a retaining ring) is shown by Curve A. Referring to FIG. 7B, the pressure on a polishing pad which is compressed by a moving substrate (again, not surrounded by a retaining ring) is shown by Curve B.

As shown by FIGS. 7A and 7B, if the substrate is motionless, then (moving from the uncompressed portion of the pad to the compressed portion of the pad) the compression in the polishing pad rises quickly just before the edge of the substrate, and then levels off to a constant value (assuming that the load on the substrate is evenly distributed). However, if the substrate moves relative to the polishing pad, e.g., if the platen rotates, then a region of high pressure 350 exists at a leading edge 352 of the substrate. One possible explanation for high pressure region 350 is a "knife edge effect". That is, as leading edge 350 of the substrate 10 travels over polishing pad 90, it attempts to scrape away pad surface 92, generating a standing wave of pressure in front of the substrate and increasing the pressure at the leading edge of the substrate. The high pressure region increases the polishing rate at the substrate's outer perimeter, usually over-polishing, but in some instances under-polishing the edge of the substrate.

In addition to retaining substrate 10 beneath the carrier head, the retaining ring assembly of the carrier head of the present invention can be used to minimize the edge effect. The retaining ring is pressed against polishing surface 92 to, in effect, "precompress" the polishing pad. This precompression alters the pressure distribution over the polishing pad to move high pressure region 350 off of substrate 10 and provide a more uniform pressure on the substrate.

The pressure on polishing pad 90 which is precompressed by the retaining ring is shown by Curve C in FIG. 7C. As can be seen from FIG. 7C, the use of the retaining ring can move the knife edge effect to a leading edge 352' of the retaining ring so that high pressure region 350' is formed beneath the retaining ring and not beneath the outer perimeter of the substrate. As a result, the retaining ring can generate a uniform pressure distribution in the polishing pad under a moving substrate. Because the pressure distribution across the substrate is uniform, the edge effect is reduced or eliminated.

The uniformity of the pressure on the substrate, and thus the severity of the edge effect, depends on the location and shape of high pressure region 350'. This depends on various factors including the load $P_1$ applied by the mounting assembly, the load $P_2$ applied by the retaining ring assembly, the width $W_1$ of the retaining ring, and the width $W_2$ of a gap 354 between the retaining ring and the substrate.

The gap 354 cannot be too large, or else the polishing pad will decompress and the retaining ring will not prevent the edge effect. Preferably, gap 354 is less than about 0.030 inches wide. Preferably, the retaining ring is between 0.2 and 0.4 inches wide, although a wider or narrower retaining ring could be used. Because both the retaining ring width ($W_1$) and the gap width ($W_2$) are set for a specific carrier head, the carrier head of the present invention controls the location and shape of high pressure region 350' with the retaining ring load.

The optimal retaining ring load, i.e., the pressure $P_2$ applied by the retaining ring assembly to the polishing pad, to minimize the edge effect depends on the various substrate processing parameters. These parameters include load $P_1$, pad rotation rate, substrate rotation rate, polishing pad rebound rate (a characteristic of the polishing pad composition), and slurry composition. The optimal load $P_2$ for a particular set of processing parameters may be determined experimentally. For example, for carrier head 180 and the following processing conditions: an IC-1400 polishing pad, a Cabot SS-12 slurry, a carrier head rotation rate of fifty-seven r.p.m., a polishing pad rotation rate of sixty-three r.p.m., a retaining ring width of 0.340 inches, a gap width of approximately twelve mils, and a carrier head load of 5.2 p.s.i., a retaining ring load of about 4.0 p.s.i. is preferred. This results in over-polishing of an annular ring about the substrate edge which is only three millimeters wide. As another example, under the same substrate processing conditions, if the carrier head applies a load of 7.3 p.s.i., then a retaining ring load of about 7.3 p.s.i. is preferred.

The retaining ring of carrier head 100 or 180 can be independently loaded against polishing pad 90, i.e., the pressure applied by the retaining ring to the polishing pad is independent of the pressure applied by the substrate backing member to the substrate. Consequently, the load on the retaining ring can be adjusted to minimize the edge effect for any set of processing parameters. This permits the same carrier head to be used in a variety of polishing operations, e.g., at a variety of substrate loads, without a significant loss in yield or throughput.

In general, the operator of a CMP apparatus using carrier head 100 or 180 selects the processing parameters, including the polishing pad material, slurry composition, pad rotation rate, carrier head rotation rate, and substrate load, in order to obtain the desired finish, flatness and polishing rate. The polishing parameters are generally determined experimentally. Then the operator selects the retaining ring load, based on the selected processing parameters, to minimize the edge effect. In operation, the pressure in chamber 130 or 208 is set to apply the selected substrate load $P_1$. Similarly, the pressure in bladder 170 or bellows chamber 309 is set to apply the selected retaining ring load $P_2$. The retaining ring load $P_2$ may be selected so that the polishing pad will not completely decompress in gap 354 between the substrate and retaining ring.

Figure 8A:
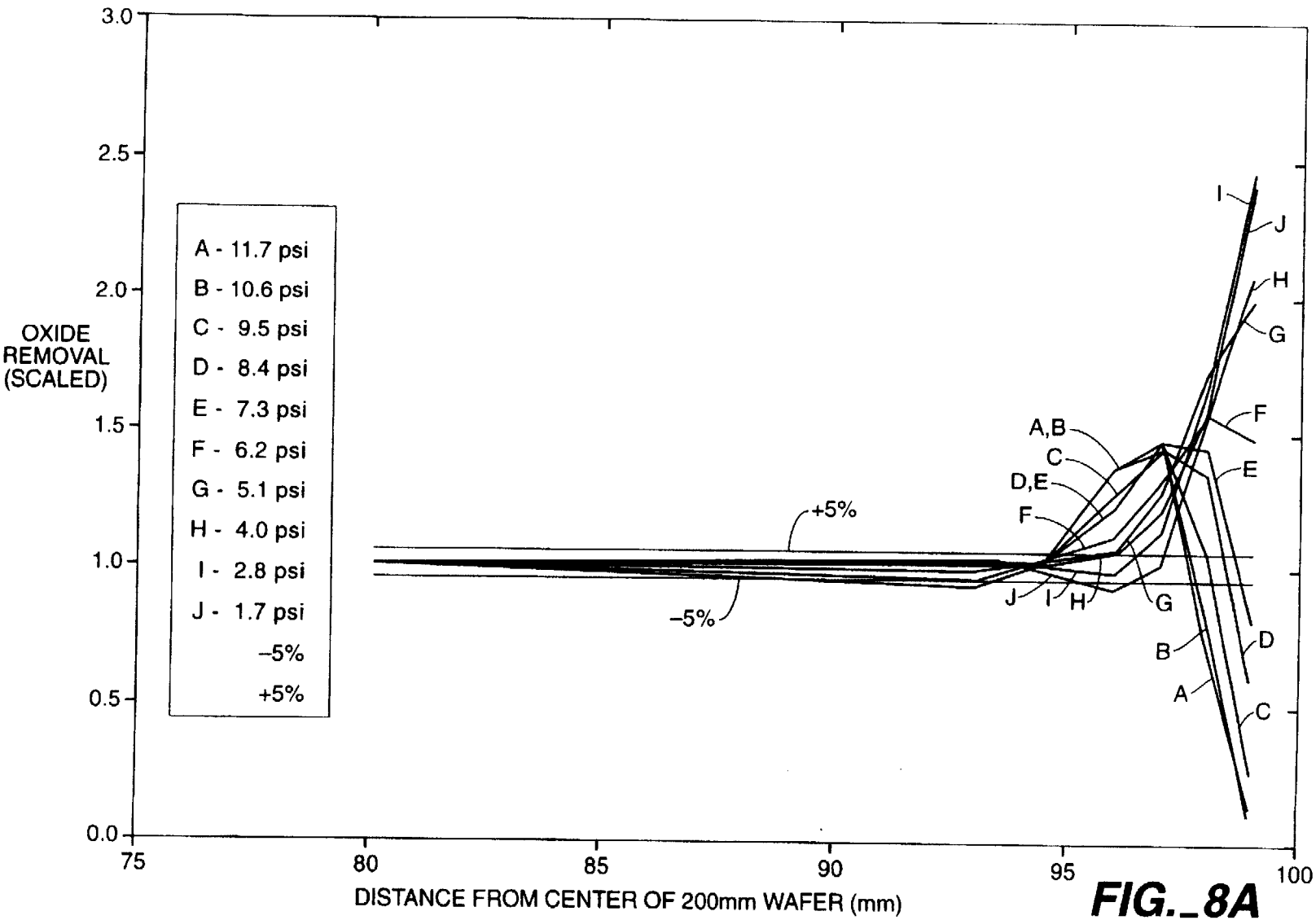
FIG. 8A is a graph showing the amount of material removed from a substrate as a function of the distance from the center of the substrate, for different retaining ring loads.

Referring to FIG. 8A, ten experimental polishing runs were carried out on 200 mm diameter substrates that were coated with a layer of oxide. The polishing was conducted using carrier head 180, an IC-1400 pad, a Cabot SS-12 slurry, a carrier head rotation rate of fifty-seven r.p.m., a pad rotation rate of sixty-three r.p.m., a retaining ring width of 0.340 inches, a gap width of about twelve mils, and a substrate load of 5.2 p.s.i. Each polishing run was conducted at a different retaining ring load. The retaining ring loads are represented by curves A–J at pressures of 11.7 p.s.i. to 1.7 p.s.i., respectively. The amount of oxide removed was measured along the radius of each substrate. In FIG. 8A, the amount of oxide removed from the substrate (the y-axis) is shown as a function of distance from the center of the substrate (the x-axis) for each retaining ring load. It may be noted that the amount of oxide removed is shown as a scaled value, i.e., as a variation from the average amount of oxide removed across the substrate in that polishing run.

Figure 8B:
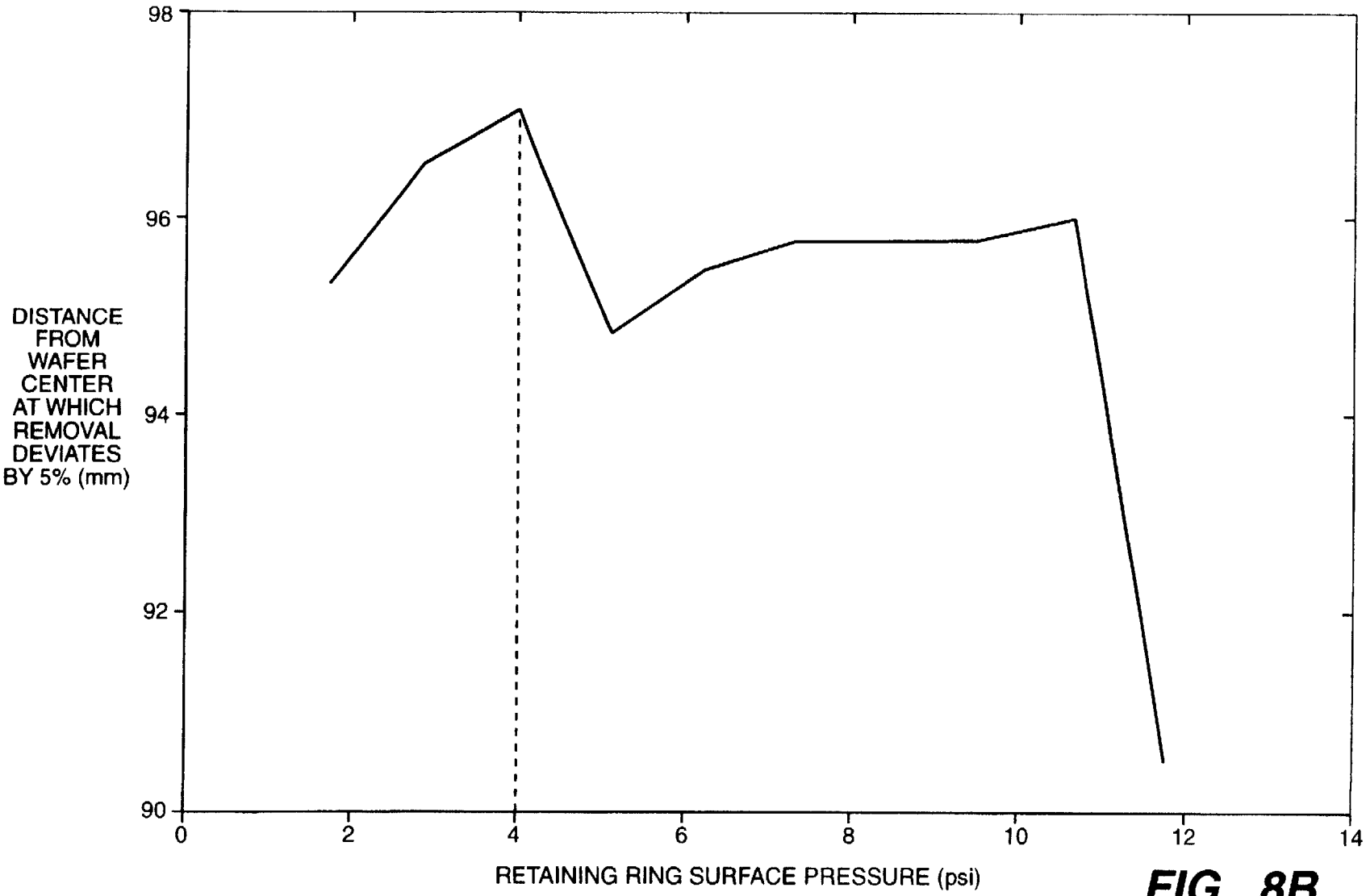
FIG. 8B is a graph showing edge exclusion as a function of the retaining ring load.

Referring to FIG. 8B, the "edge exclusion", i.e., the thickness of the annular area at the edge of the substrate which is unsuitable for an integrated circuit, was calculated from the data obtained in the experimental polishing runs of FIG. 8A. It may be assumed that the edge exclusion begins at the radius at which the amount of oxide removed varies by about at least five percent from the average (either above or below the average as represented by the lines labeled as +5% and −5% on FIG. 8A) of the amount of oxide removed across the substrate. In FIG. 8B, the distance from the center of the substrate at which the amount of oxide removed varies by five percent from the average (the y-axis) is shown as a function of the retaining ring pressure (the x-axis). At the optimal retaining ring load of about four p.s.i., the polishing operation produces substrates with an edge exclusion of only about three millimeters.

As the substrate load $P_1$ or the carrier head rotation rate increases, the optimum retaining ring load $P_2$ also increases (not necessarily in direct proportion). Because the retaining ring load $P_2$ may be selected independently of the substrate load $P_1$ by adjusting the pressure in bladder 170 or bellows chamber 309, a single carrier head can be used for a variety of processing parameters.

In summary, the present invention provides a method for precompressing the polishing pad to reduce or minimize the edge effect. A substrate is pressed against a polishing pad with a first load by a mounting assembly while the polishing pad rotates. A second load is selected and independently applied by the retaining ring. This method provides improved yield and generates substrates having a larger area usable for integrated circuits.

Polishing may be performed on metallic, semiconductive or insulative layers. The particular reactive agents, abrasive particles, and catalysts will differ depending on the surface being polished. The present invention is applicable to polishing any of the above layers.

The present invention has been described in terms of a preferred embodiment. The invention, however, is not limited to the embodiment depicted and described. Rather, the scope of the invention is defined by the appended claims.

What is claimed is:

1. A method of chemically mechanically polishing a substrate, comprising the steps of:

positioning a substrate adjacent to a polishing pad by means of a carrier head, said carrier head including a mounting assembly and a retaining ring;

moving said substrate relative to said polishing pad;

applying a first load to said mounting assembly to press said substrate against said polishing pad;

selecting a second load to be applied by said retaining ring to minimize an edge effect on said substrate; and independently applying said second load to said retaining ring to press said retaining ring against said polishing pad.

2. The method of claim 1 wherein the step of moving the substrate relative to the polishing pad includes the step of rotating said substrate.

3. The method of claim 1 further the step of moving the substrate relative to the polishing pad includes the step of rotating the polishing pad.

4. The method of claim 1 wherein the first load is greater than the second load.

5. The method of claim 1 wherein the second load is greater than the first load.

* * * * *

UNITED STATES PATENT AND TRADEMARK OFFICE

CERTIFICATE OF CORRECTION

PATENT NO. : 5,795,215

DATED : August 18, 1998

INVENTOR(S) : William L. Guthrie, et al.

It is certified that error appears in the above-indentified patent and that said Letters Patent is hereby corrected as shown below:

On the title page, item [56] insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE | |
|---|---|---|---|---|---|---|---|---|---|---|---|---|---|---|
| | | 3 | 7 | 0 | 8 | 9 | 2 | 1 | 01/73 | P. Cronkhite et al | | | | |
| | | 3 | 5 | 5 | 9 | 3 | 4 | 6 | 02/02/71 | Paola | | | | |
| | | 3 | 7 | 3 | 1 | 4 | 3 | 5 | 05/08/73 | Boettcher, et al. | | | | |
| | | 4 | 2 | 5 | 6 | 5 | 3 | 5 | 03/17/81 | Banks | | | | |
| | | 4 | 2 | 7 | 0 | 3 | 1 | 6 | 06/02/81 | Kramer, et al. | | | | |
| | | 4 | 3 | 7 | 3 | 9 | 9 | 1 | 02/15/83 | Banks | | | | |
| | | 4 | 4 | 3 | 5 | 2 | 4 | 7 | 03/06/84 | Basi, et al. | | | | |
| | | 4 | 5 | 1 | 9 | 1 | 6 | 8 | 05/28/85 | Cesna | | | | |
| | | 4 | 6 | 0 | 0 | 4 | 6 | 9 | 07/15/86 | Fusco, et al. | | | | |
| | | 4 | 7 | 2 | 6 | 1 | 5 | 0 | 02/23/88 | Nishio, et al. | | | | |
| | | 4 | 9 | 1 | 8 | 8 | 6 | 9 | 04/24/90 | Kitia | | | | |
| | | 4 | 9 | 1 | 8 | 8 | 7 | 0 | 04/24/96 | Torbert, et al. | | | | |
| | | 4 | 9 | 4 | 4 | 1 | 1 | 9 | 07/31/90 | Gill, Jr., et al. | | | | |
| | | 4 | 9 | 5 | 4 | 1 | 4 | 2 | 09/04/90 | Carr, et al. | | | | |
| | | 5 | 0 | 8 | 1 | 7 | 9 | 5 | 01/21/95 | Tamaka, et al. | | | | |
| | | 5 | 0 | 9 | 5 | 6 | 6 | 1 | 03/17/92 | Gill, Jr., et al. | | | | |
| | | 5 | 1 | 9 | 3 | 3 | 1 | 6 | 03/16/92 | Olmstead | | | | |
| | | 5 | 2 | 0 | 5 | 0 | 8 | 2 | 04/27/93 | Shendon, et al. | | | | |
| | | 5 | 2 | 3 | 0 | 1 | 8 | 4 | 07/27/93 | Bukhman | | | | |
| | | 5 | 2 | 3 | 2 | 8 | 7 | 5 | 08/03/93 | Tuttle, et al. | | | | |
| | | 5 | 2 | 5 | 5 | 4 | 7 | 4 | 10/26/93 | Gawa, et al. | | | | |
| | | 5 | 3 | 9 | 8 | 4 | 5 | 9 | 03/21/95 | Okumura, et al. | | | | |
| | | 5 | 4 | 2 | 3 | 7 | 1 | 6 | 06/13/95 | Strasbaugh | | | | |
| | | 5 | 4 | 4 | 1 | 4 | 4 | 4 | 08/15/95 | Nakajima | | | | |
| | | 5 | 4 | 7 | 6 | 4 | 1 | 4 | 12/19/95 | Hirose, et al. | | | | |

UNITED STATES PATENT AND TRADEMARK OFFICE

CERTIFICATE OF CORRECTION

PATENT NO. : 5,795,215

DATED : August 18, 1998

INVENTOR(S) : William L. Guthrie, et al.

It is certified that error appears in the above-indentified patent and that said Letters Patent is hereby corrected as shown below:

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | 63 | - | 1 | 1 | 4 | 8 | 7 | 0 | 05/19/88 | Japan | | | | |
| | 1 | - | 1 | 0 | 9 | 0 | 6 | 6 | 04/26/89 | Japan | | | | |
| | 1 | - | 2 | 1 | 6 | 7 | 6 | 8 | 08/30/89 | Japan | | | | |
| | JP | 61 | - | 2 | 5 | 7 | 6 | 8 | 02/04/86 | Japan | | | | |
| | DE | 8 | 6 | 3 | 1 | 0 | 8 | 7 5 | 04/16/87 | Germany | | | | |
| | JP | 63 | - | 3 | 0 | 0 | 8 | 5 8 | 12/08/88 | Japan | | | | |
| | JP | 2 | - | 2 | 4 | 3 | 2 | 6 3 | 09/27/90 | Japan | | | | |
| | EP | 0 | 6 | 5 | 3 | 2 | 70 | A1 | 08/31/94 | Europe | | | | |
| | WO | 94 | 1 | 9 | 1 | 1 | 5 | 3 | 09/01/94 | U.S.A. | | | | |
| | EP | 0 | 1 | 5 | 6 | 7 | 4 | 6 A1 | 10/02/85 | Europe | | | | |

FOREIGN PATENT OR PUBLISHED FOREIGN PATENT APPLICATION

| |
|---|
| Research Disclosure, n. 322, February 1, 1991, page 95, XPO 00168310 *Pressurized Wafer Holder for Uniform* |
| Jun Yuan et al. Cybeq Systems, 1995 VMIC Conference, pages 525-527, *A Novel Wafer Carrier Ring Design Minimizes Edge Over-Polishing Effects For Chemical Mechanical Polishing*. |

Signed and Sealed this

Twenty-sixth Day of October, 1999

*Attest:*

*Attesting Officer*

Q. TODD DICKINSON

*Acting Commissioner of Patents and Trademarks*